US007748573B2

(12) United States Patent
Anhuf et al.

(10) Patent No.: US 7,748,573 B2
(45) Date of Patent: Jul. 6, 2010

(54) REMOVABLE NOZZLE SHIELD FOR FLUID DISPENSER

(75) Inventors: Martin Anhuf, Kamp-Lintfort (DE); Hermann Ophardt, Issum (DE)

(73) Assignee: Gotohti.Com, Beamsville, Ontario (CA)

( * ) Notice: Subject to any disclaimer, the term of this patent is extended or adjusted under 35 U.S.C. 154(b) by 812 days.

(21) Appl. No.: 11/706,418

(22) Filed: Feb. 15, 2007

(65) Prior Publication Data

US 2007/0210110 A1 Sep. 13, 2007

(30) Foreign Application Priority Data

Mar. 8, 2006 (CA) ..... 2538876

(51) Int. Cl.
*A47K 5/12* (2006.01)
*B65D 83/28* (2006.01)
*B65D 83/16* (2006.01)

(52) U.S. Cl. ..... 222/180; 222/182; 222/321.8; 220/812; 16/361

(58) Field of Classification Search ..... 222/180, 222/181.3, 182, 321.8; 220/812; 16/361
See application file for complete search history.

(56) References Cited

U.S. PATENT DOCUMENTS

| | | | | |
|---|---|---|---|---|
| 2,121,231 | A * | 6/1938 | Hartog | 220/812 |
| 2,747,388 | A * | 5/1956 | Dolar | 220/812 |
| 3,107,025 | A * | 10/1963 | Cowan | 220/812 |
| 3,233,787 | A * | 2/1966 | Ross | 222/321.8 |
| 4,186,855 | A * | 2/1980 | Edman et al. | 222/321.8 |
| 4,582,227 | A * | 4/1986 | Kanfer | 222/180 |
| 5,435,463 | A * | 7/1995 | Hodgson | 222/182 |
| 5,992,698 | A * | 11/1999 | Copeland et al. | 222/180 |
| 6,230,935 | B1 * | 5/2001 | Mack et al. | 222/321.8 |
| 6,401,985 | B1 * | 6/2002 | DeMars | 222/129 |
| 7,121,432 | B2 * | 10/2006 | Kostal et al. | 222/182 |
| 7,299,951 | B2 * | 11/2007 | Jahnke et al. | 222/321.8 |
| 7,654,417 | B2 * | 2/2010 | Rhodenbaugh et al. | 222/181.3 |

FOREIGN PATENT DOCUMENTS

| | | | |
|---|---|---|---|
| EP | 1588773 | A2 | 10/2005 |
| GB | 2189847 | A | 11/1987 |
| WO | WO 01/47590 | A1 | 7/2001 |

* cited by examiner

*Primary Examiner*—Kenneth Bomberg
(74) *Attorney, Agent, or Firm*—Riches, McKenzie & Herbert LLP

(57) ABSTRACT

A coupling mechanism for coupling a nozzle shield to a dispenser housing using interacting hook members and axle members. One of the hook members and axle members is carried by the housing. The member which is carried by the housing is preferably movable between a forward and a rear position as by being slidable relative to the housing and spring biased as to a rear position. In moving the cover from a closed position to a forward position, the hook member and axle member are in engagement with the member which is movable relative to the housing, preferably moved against the spring bias. For removal of the cover, with the cover approximate the closed position, the member which is carried by the housing is moved relative the housing against the spring bias to a forward position in which the hook member may be disengaged from the axle member.

20 Claims, 16 Drawing Sheets

11
10
12
13
40
14

REMOVABLE NOZZLE SHIELD FOR FLUID DISPENSER

SCOPE OF THE INVENTION

This invention relates to fluid dispensers and, more particularly, to a fluid dispenser including a removable cover, preferably, a removable nozzle shield.

BACKGROUND OF THE INVENTION

Various fluid dispensers are known which have shields protecting a nozzle from which fluid is to be dispensed, however, such previously known devices typically suffer the disadvantage that the shield is not readily removable for replacement.

SUMMARY OF THE INVENTION

To at least partially overcome these disadvantages of previously known devices, the present invention provides a fluid dispenser with a cover, preferably a nozzle shield, which is readily removable for replacement.

An object of the present invention is to provide an improved fluid dispenser with a substantially tamper-free replaceable cover, preferably a nozzle shield.

Another object is to provide a construction for a nozzle shield for a fluid dispenser which is capable of being moved between open and closed positions to permit access to the interior of the dispenser yet is adapted for ease of replacement.

The present invention provides a coupling mechanism for coupling a nozzle shield to a dispenser housing interacting hook members and axle members. One of the hook members and axle members is carried by the housing. The member which is carried by the housing is preferably movable between a forward and a rear position as by being slidable relative to the housing and spring biased as to a rear position. In moving the cover from a closed position to a forward position, the hook member and axle member are in engagement with the member which is movable relative to the housing, preferably moved against the spring bias. For removal of the cover, with the cover approximate the closed position, the member which is carried by the housing is moved relative the housing against the spring bias to a forward position in which the hook member may be disengaged from the axle member.

In one aspect, the present invention provides a fluid dispenser having a housing, a cover coupled to the housing for movement between a closed position in which the dispenser is operative for dispensing fluid and an open position in which access is provided to an interior of the housing, the cover and the housing coupled together by a releasable connection mechanism including an axle member disposed about an longitudinal axis carried by a first member selected from the cover and the housing, and a hook member carried by a second member which selected from the cover and the housing but is not the first member, the one of the axle member and hook member which is carried by the housing being movable relative the housing in a direction normal to the axis between a first rear position and a second forward position, a biasing member urging the one of the axle member and hook member which is carried by the housing to assume the first rear position, the one of the axle member and hook member which is carried by the housing being movable from the first rear position to the second forward position against the bias of the biasing member, the hook member removably engaging the axle member, wherein when the hook member engages the one of the axle member and hook member which is carried by the housing: (a) the cover is in the closed position when the one of the axle member and hook member which is carried by the housing is in the first rear position, (b) the axle biasing member in urging the one of the axle member and hook member which is carried by the housing to the first position urges the cover to the closed position, and (c) movement of the cover from the closed position to the open position moves the one of the axle member and hook member which is carried by the housing from the first rear position to the second forward position against the bias of the axle biasing member, the hook member being engageable and disengageable from the axle member for coupling and uncoupling of the cover relative to the housing when the one of the axle member and hook member which is carried by the housing is in the second front position and the cover member is proximate the closed position.

In another aspect, the present invention provides a fluid dispenser having a housing, an axle member carried by the housing, the axle member disposed about a longitudinal axis, the axle member being movable relative the housing in a direction normal to the axis between a first rear position and a second forward position, a axle biasing member urging the axle member to assume the first rear position, the axle member being movable from the first rear position to the second forward position against the bias of the biasing member, a cover coupled to the housing for movement between a closed position in which the dispenser is operative for dispensing fluid and an open position in which access is provided to an interior of the housing, the cover having a rearwardly extending hook member, the hook member removably engaging the axle member, wherein when the hook member engages the axle member: (a) the cover is in the closed position when the axle member is in the first rear position, (b) the axle biasing member in urging the axle member to the first position urges the cover to the closed position, and (c) movement of the cover from the closed position to the open position moves the axle member from the first rear position to the second forward position against the bias of the axle biasing member, the hook member being engageable and disengageable from the axle member for coupling and uncoupling of the cover relative to the housing when the axle member is in the second front position and the cover member is proximate the closed position.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
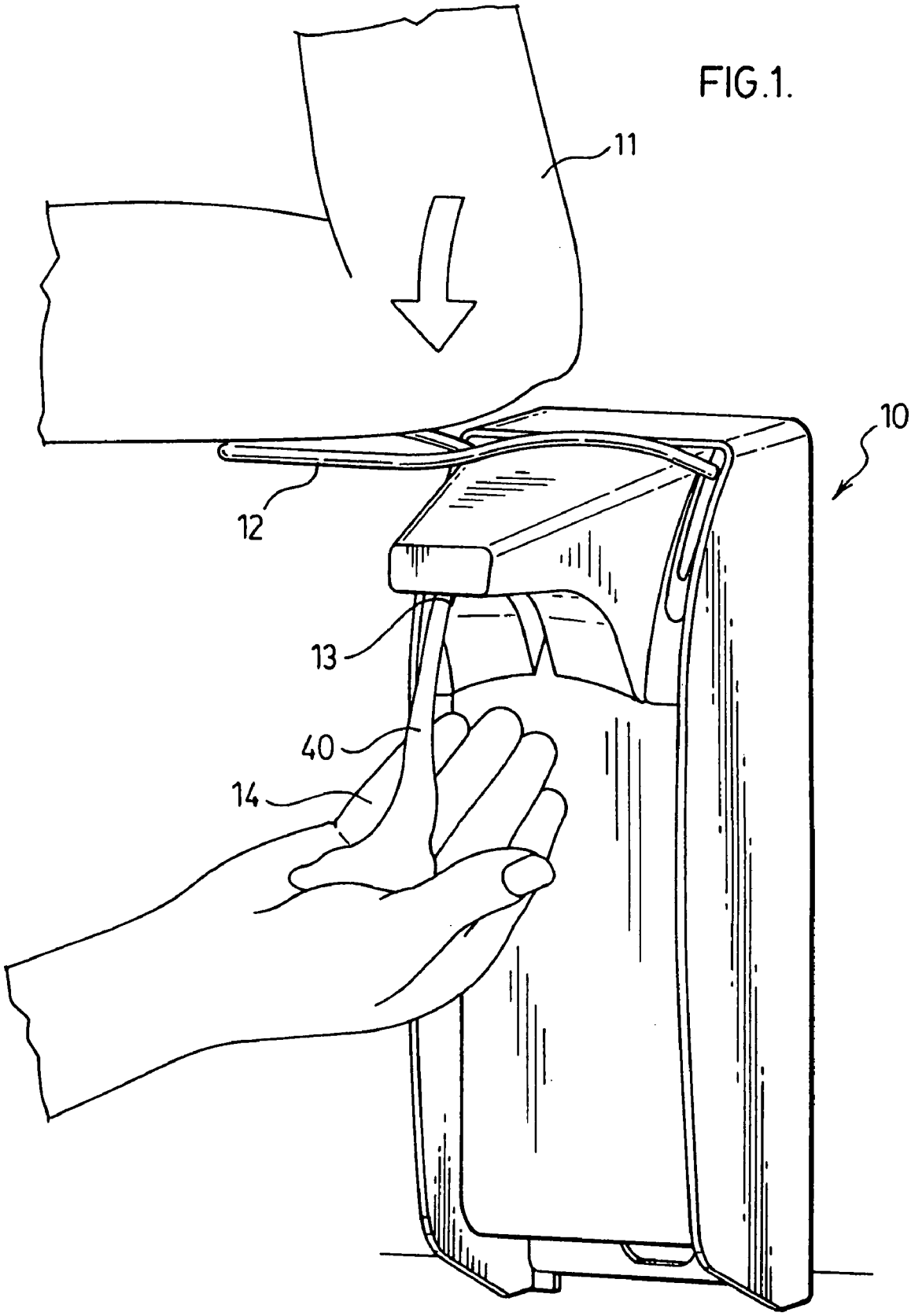
FIG. 1 is a perspective view of a soap dispenser in accordance with a first embodiment of the invention schematically shown as being manually used by a user to dispense hand soap.

Reference is made first to FIG. 1 which illustrates a first embodiment of a fluid dispenser 10 adapted to be secured to a wall not shown and schematically illustrated in FIG. 1 as adapted for manual activation as by a user using one arm 11 to urge a lever 12 downwardly so as to dispense fluid from a nozzle 13 onto the hand 14 of the other user's arm.

Figure 5:
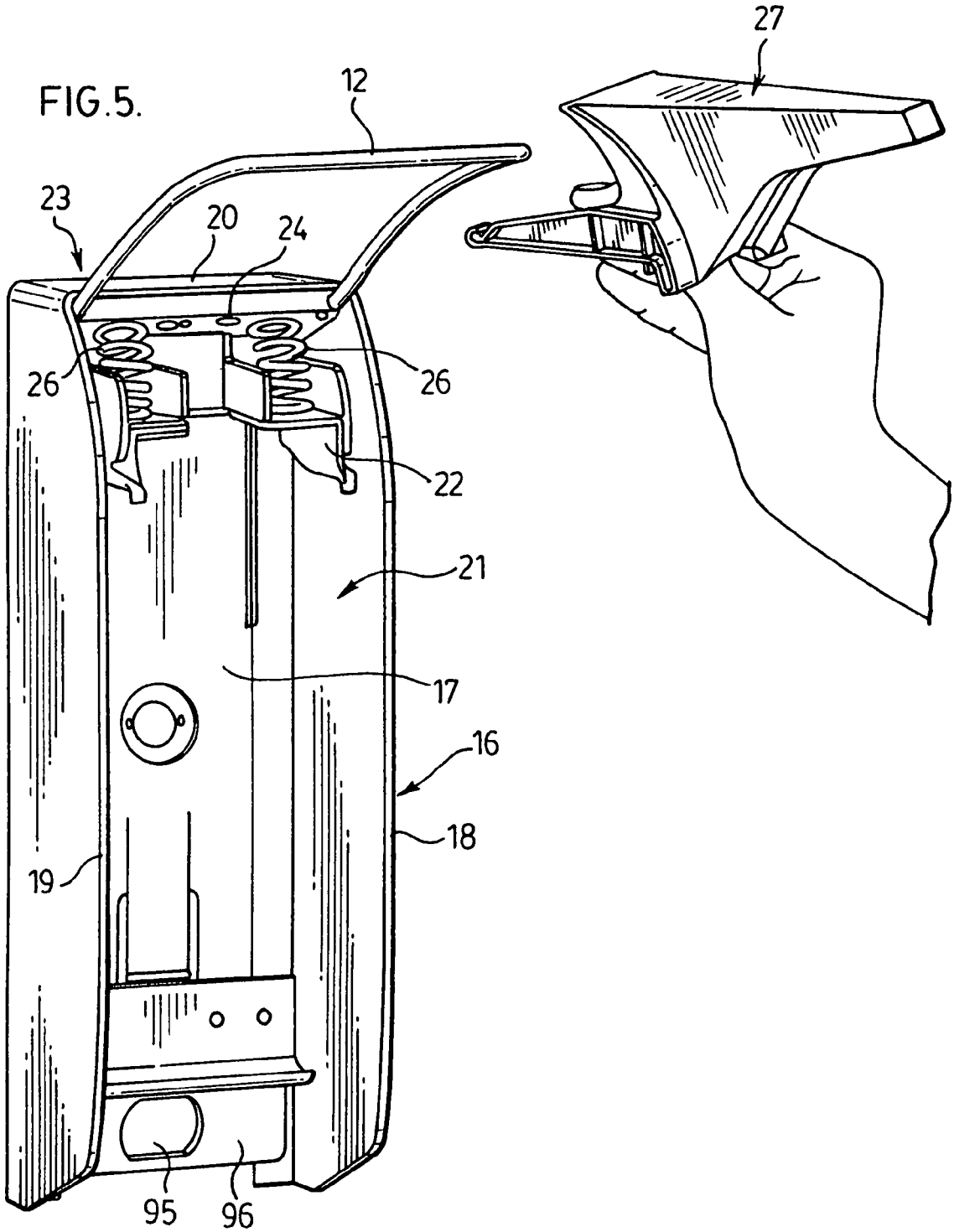
FIG. 5 is a perspective view of the dispenser shown in FIG. 4 with the nozzle shield removed.

Referring to FIG. 5, the dispenser includes a housing 16 having a back plate 17, spaced side walls 18 and 19 and a top wall 20 defining an interior 21 therebetween. A housing chassis/support member 22 is fixedly secured in the interior of the housing between the side walls 18 and 19 proximate the top wall 20. A lever mechanism 23 including the lever 12 and a lever bridge plate 24 is pivotally mounted to the support member 22 about axle studs 25 carried on the sides of the support member 22 best seen in FIG. 7. Lever springs 26 are disposed between the lever bridge plate 24 and the support member 22 so as to bias the lever 12 to an upper raised position.

FIG. 5 shows a nozzle shield 27 separate from the housing 16 and ready for manual coupling to the support member 22.

Figure 2:
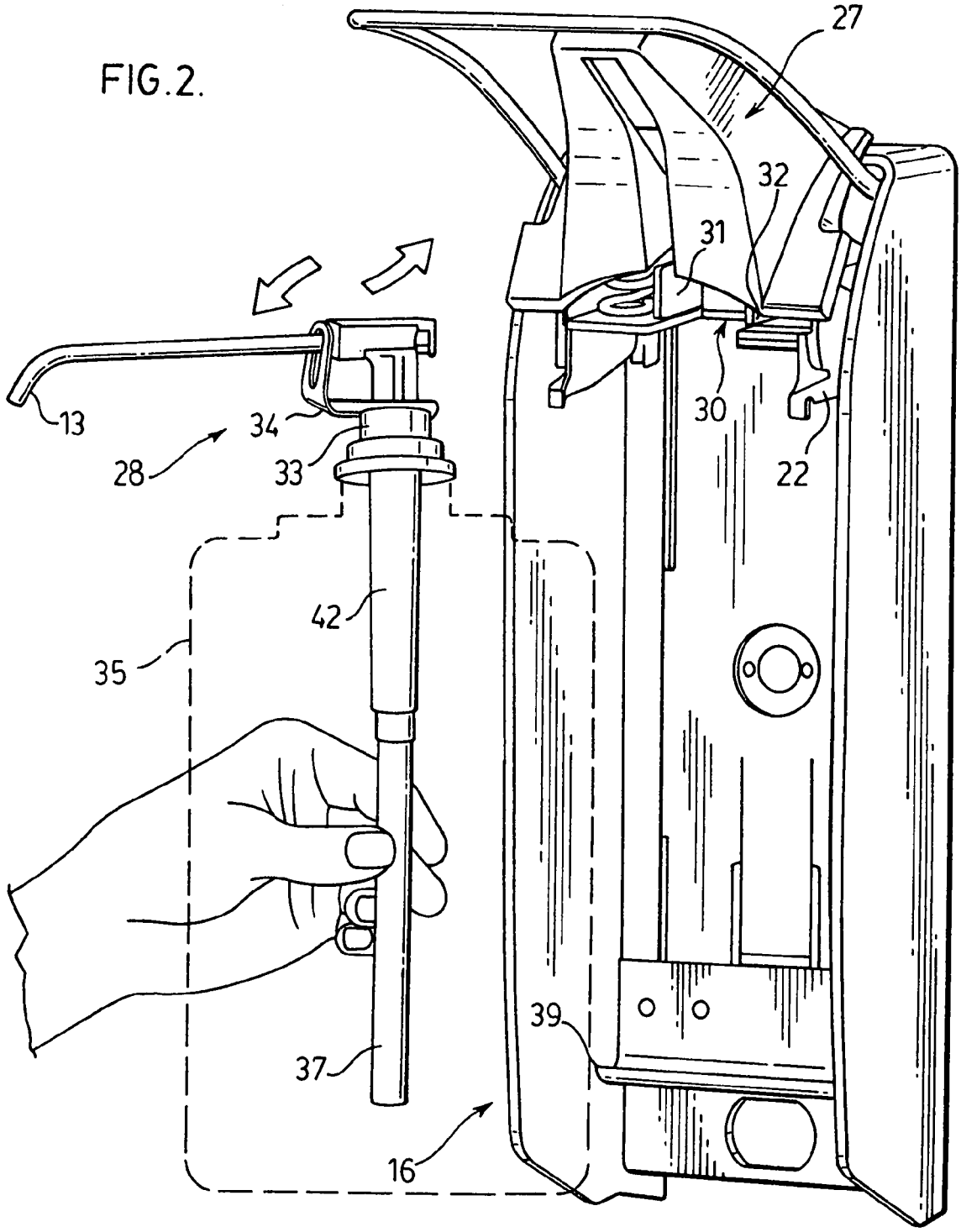
FIG. 2 is a perspective view of the soap dispenser of FIG. 1, however, with a nozzle shield in a raised, open position, the bottle removed and a pump mechanism being manually held by a user ready for insertion or removal.
Figure 7:
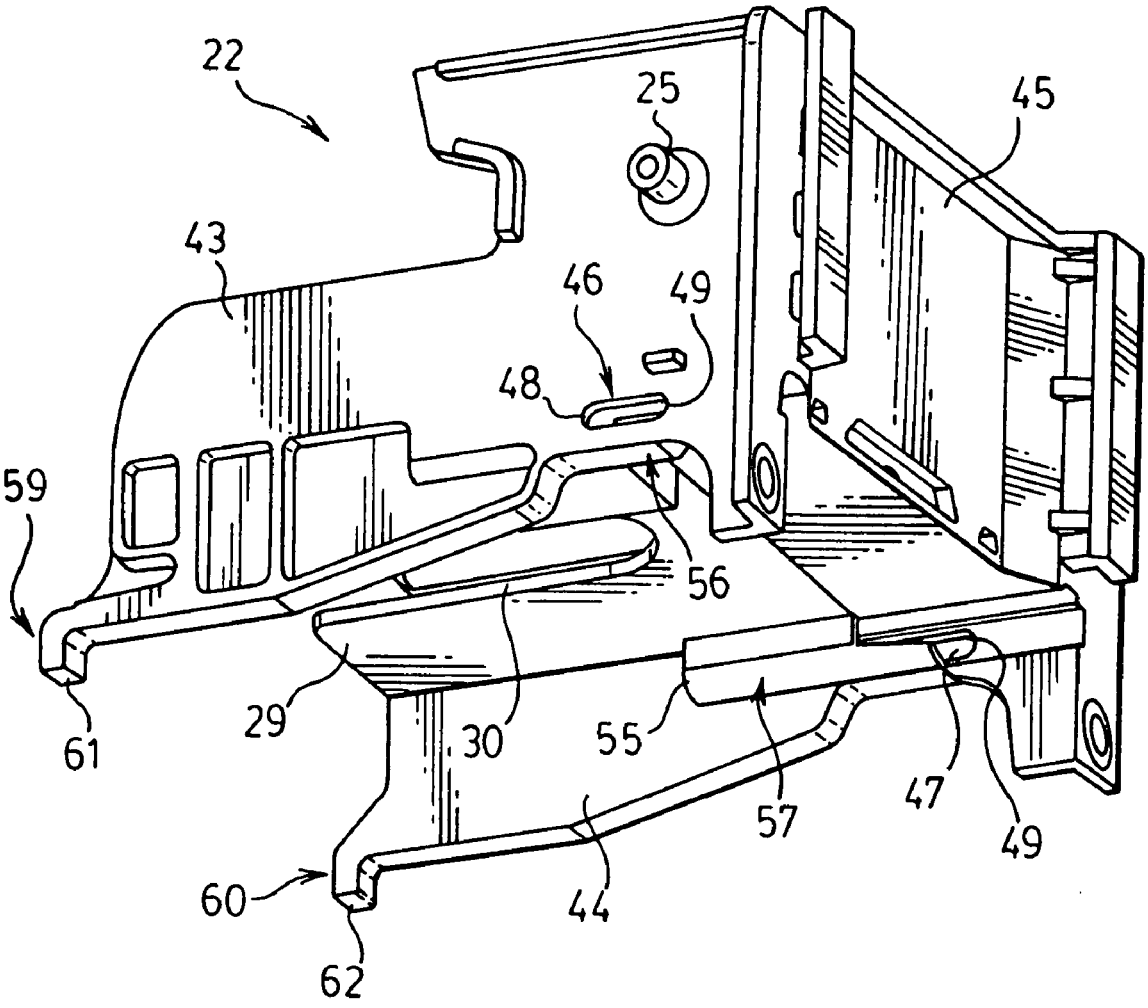
FIG. 7 is a rear perspective view of a housing chassis shown in FIG. 5.

FIG. 2 illustrates the dispenser 10 with the nozzle shield 27 coupled to the support member 22 and placed in a raised open position in which position the nozzle shield 27 permits a pump mechanism 28 to be coupled or uncoupled to the support member 22 by sliding forwardly or rearwardly. In this regard, the support member 22 as best seen in FIG. 7, carries a support plate 29 with a central slot 30 open at a forward end. As seen in FIG. 2, vertical side walls 31 and 32 extend upwardly from the support plate 29 on each side thereof. The pump mechanism 28 is adapted to slide rearwardly into the central slot 30 with the slot 30 disposed about a cylindrical portion 33 with an enlarged radius rectangular plate 34 above the cylindrical portion 33 to be received above the support plate 29 and located against rotation between the side walls 31 and 32.

Figure 3:
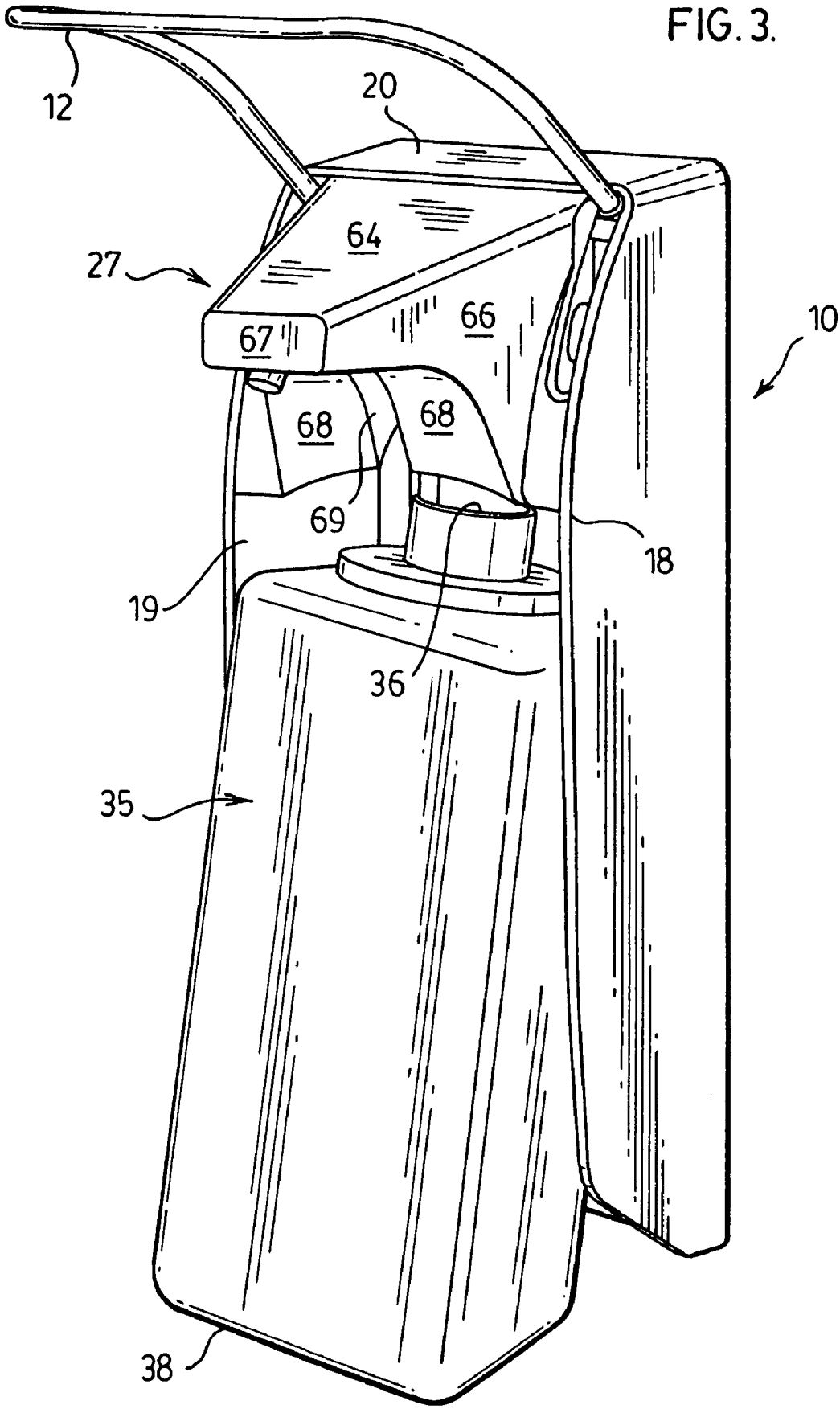
FIG. 3 is a perspective view of the soap dispenser of FIG. 1 in which the pump mechanism is coupled to the housing, the nozzle shield is in a closed position and a bottle is being replaced.

Reference is made to FIG. 3 which illustrates a dispenser 10 after the pump mechanism 28 has been applied as in FIG. 2 and the nozzle shield 27 moved from the raised open position of FIG. 2 to the closed position seen in FIG. 3. A bottle 35 with an open upper end 36 may be, when disposed at an angle, placed to have the dip tube 37 of the pump mechanism inside its open end 36 and the bottle then slid upwardly between the side walls 18 and 19 of the housing 16 upwardly about the dip tube 37 to a position where the bottom 38 of the bottle is disposed above a height of a support ledge 39 secured across the back of the housing 16. The bottom 38 of the bottle 35 may then be pushed rearwardly to rest on the support ledge 39 for use. With the bottle 35 inserted and in the position, for example, as illustrated in FIG. 1, pressing downwardly on the lever 12 will dispense fluid 40 out of the nozzle 13 of the pump mechanism 28. The pump mechanism 28 preferably comprises a piston pump assembly with the nozzle 13 comprising a forward hollow tubular extension from a piston 41 which is slidable within a piston chamber forming element 42 which has liquid fed to it from the bottle 38 via the dip tube 37. The piston 44 is reciprocally vertically displaced by the lever mechanism 23 to pump fluid.

While FIGS. 2 and 3 show one arrangement in which the bottle 35 may be replaced independently of the pump mechanism 28, FIG. 2 schematically illustrates in dashed lines, a bottle 35 secured to the pump mechanism 28 such that a unit, preferably disposable, comprising a pump mechanism 28 in combination with the bottle 35 may be removed and replaced merely by the forward access to the interior 21 of the housing 16 with the nozzle shield 28 in a raised open position.

Figure 8:
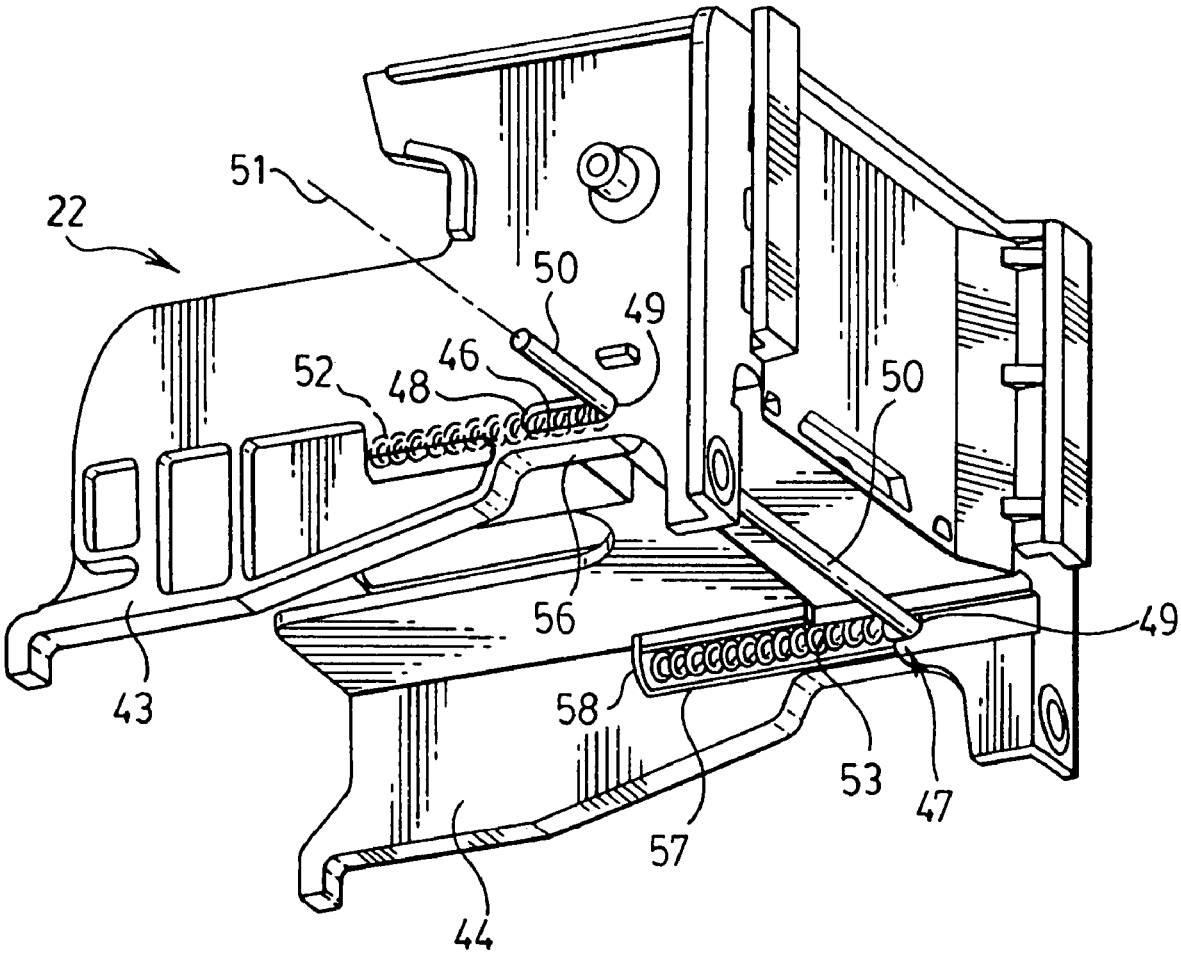
FIG. 8 shows the housing chassis as in FIG. 7, however, as including a slidable axle member and with a portion of the housing chassis cut away to schematically illustrate axle springs which bias the axle member to a rear position.

Reference is made to FIGS. 7 and 8 which illustrate the support member 22. As can be seen in FIG. 7, the support member 22 is symmetrical about a vertical central plane. The support member 22 has two generally parallel vertically extending side plates 43 and 44 joined proximate their rear by a generally vertically extending back plate 45 and with the support plate 29 extending generally horizontally from the back plate 45 forward between the side plates 43 and 44.

Two horizontally extending axle slotways 46 and 47 are provided through the side plates 43 and 44 below the support plate 29. Each of the slotways 46 and 47 have a forward end 48 and a rear end 49.

FIG. 8 is the same as FIG. 7, however, illustrates an axle member 50 which comprises an elongate straight metal rod disposed about a longitudinal axis 51 which extends horizontally through each of the axle slotways 46 and 47 and is adapted for sliding in the slotways forwardly and rearwardly normal to the axis 51. Two helical coil axle springs 52 and 53 engage the axle member 50 and urge it towards the rear end 49 of the axle slotways 46 and 47. The axle springs 52 and 53 are received inside blind spring receiving bores formed in tube-like members 56 and 57 on the support member 22 underneath the support plate 29. One of the tube members 57 is shown partially cut away in FIG. 8 so as to show its spring receiving bore and a forward closed in wall 58. The axle spring 53 is shown as being biased between the end wall 58 at a forward end and the side surface of the axle member 50 at its rear end.

The support member 22 carries at the front lower end of each of its side plates 43 and 44, two catch members 59 and 60, each providing a respective downwardly directed stop surface 61 and 62.

Figure 4:
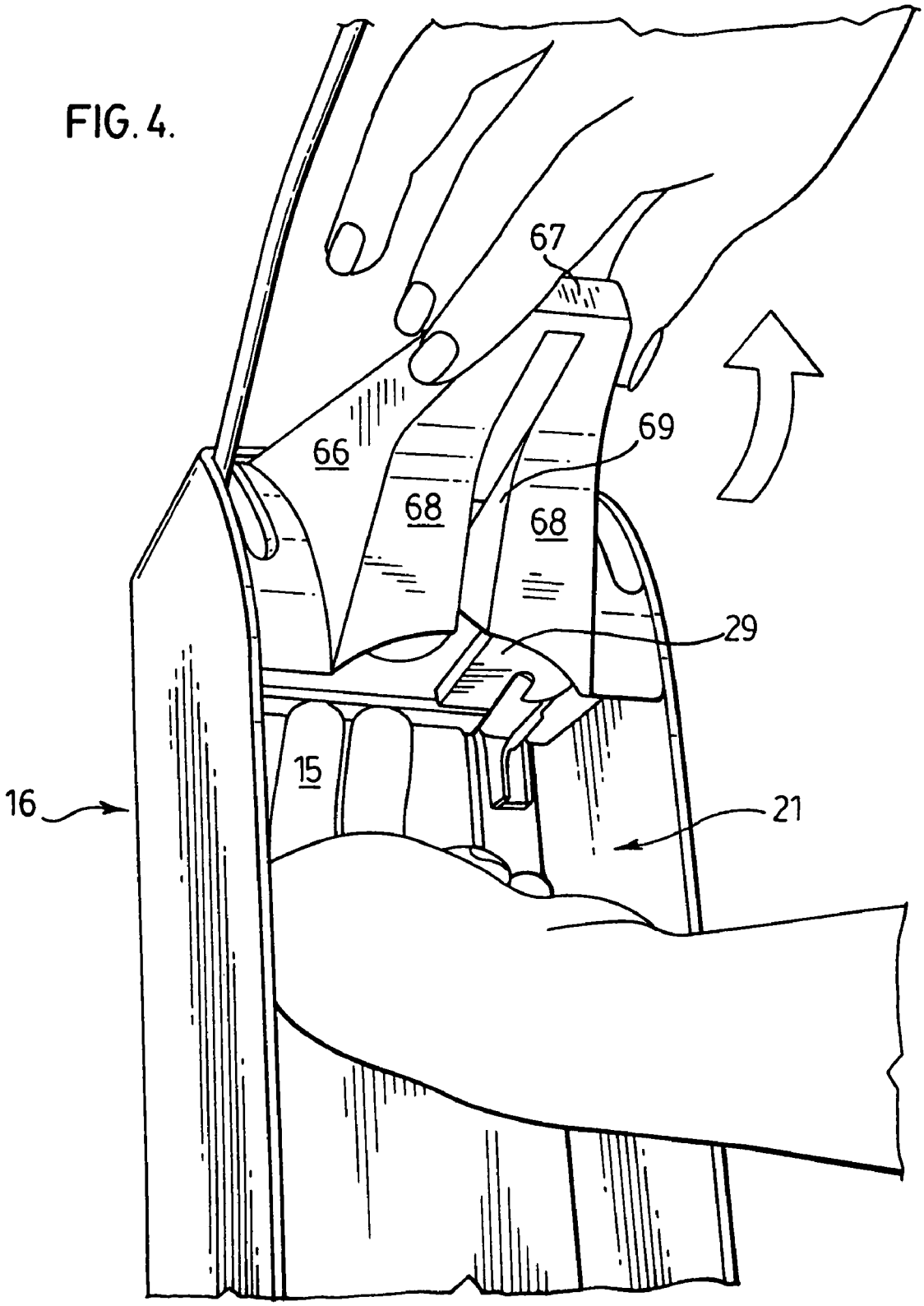
FIG. 4 is a perspective view of the soap dispenser of FIG. 1 in which the bottle and the pump mechanism has been removed and a user is manually urging an axle member forwardly for removal of the nozzle shield.
Figure 6:
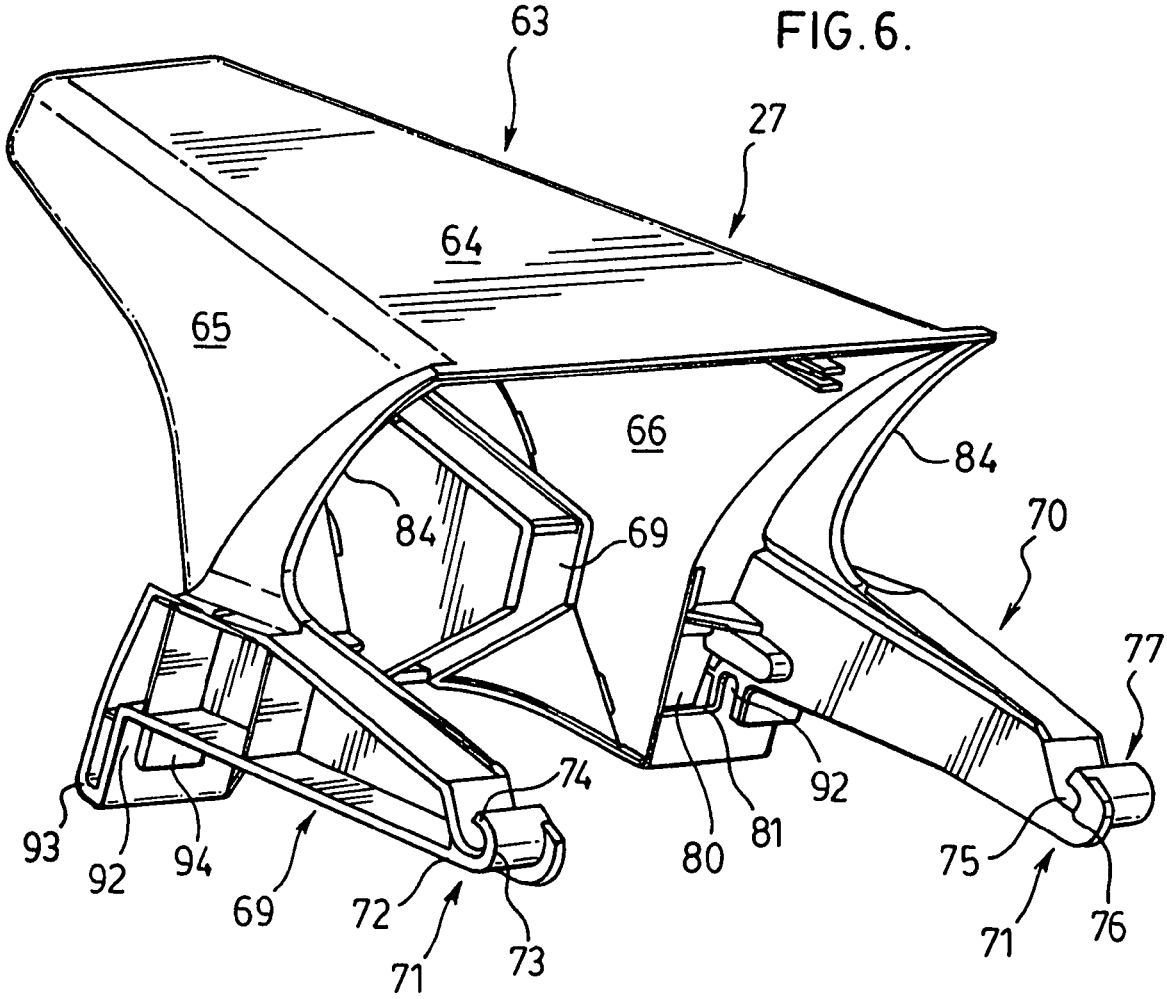
FIG. 6 is a rear perspective view of the nozzle shield shown in FIGS. 1 to 5.

Reference is made to FIG. 6 providing a pictorial view of the nozzle shield 27. The nozzle shield has a forwardly extending nozzle shroud portion 63 with a top wall 64, two side walls 65 and 66, a front wall 67 and a bottom wall 68. The bottom wall has a vertical central channelway 69 therethrough as best seen in FIGS. 2 and 4 to accommodate the nozzle 13. The channelway 69 permits, for example, in use the relative vertical movement of the nozzle 13 relative to the nozzle shield 27 and, as well, for the nozzle shield 27 to be moved relative to the nozzle 13 between the open position shown in FIG. 2 and the closed position shown in FIG. 3. From the rear of each side wall 65 and 66 of the nozzle shroud portion 63, two hook arms 69 and 70 extend rearwardly. Each hook arm 69 and 70 carries a respective hook member 71 at its rear. Each hook member has a shank portion 72 extending rearwardly to a bight forming portion 73 which curves forwardly to a distal forward end 74 so as to define a blind slotway 75 closed at a rearwardmost bight end 76 and open via an entranceway 77 forward of the bight end between the shank portion 72 and the distal forward end 74. The entranceway 77 to the blind slotway 75 is on an upper side of the shank portion 72 and opens outwardly and upwardly from the blind slotway 75.

In assembly of the nozzle shield 27 onto the support member 22, each hook member 71 is to engage the axle member 50 where the axle member extends to the side laterally outwardly of the side plates 43 and 44 of the support member 22.

The nozzle shield 27 is also symmetrical about a vertical central plane between its hook arms 69 and 70. As seen in FIG. 6, a catch cavity 80 is provided laterally inwardly from the hook arm 70 and presents an upwardly directed stop surface 81. As will be discussed later in greater detail, the catch cavity 80 is adapted to interact with the support member 22 with the stop surfaces 61 and 62 to engage with the stop surfaces 81.

Figure 9:
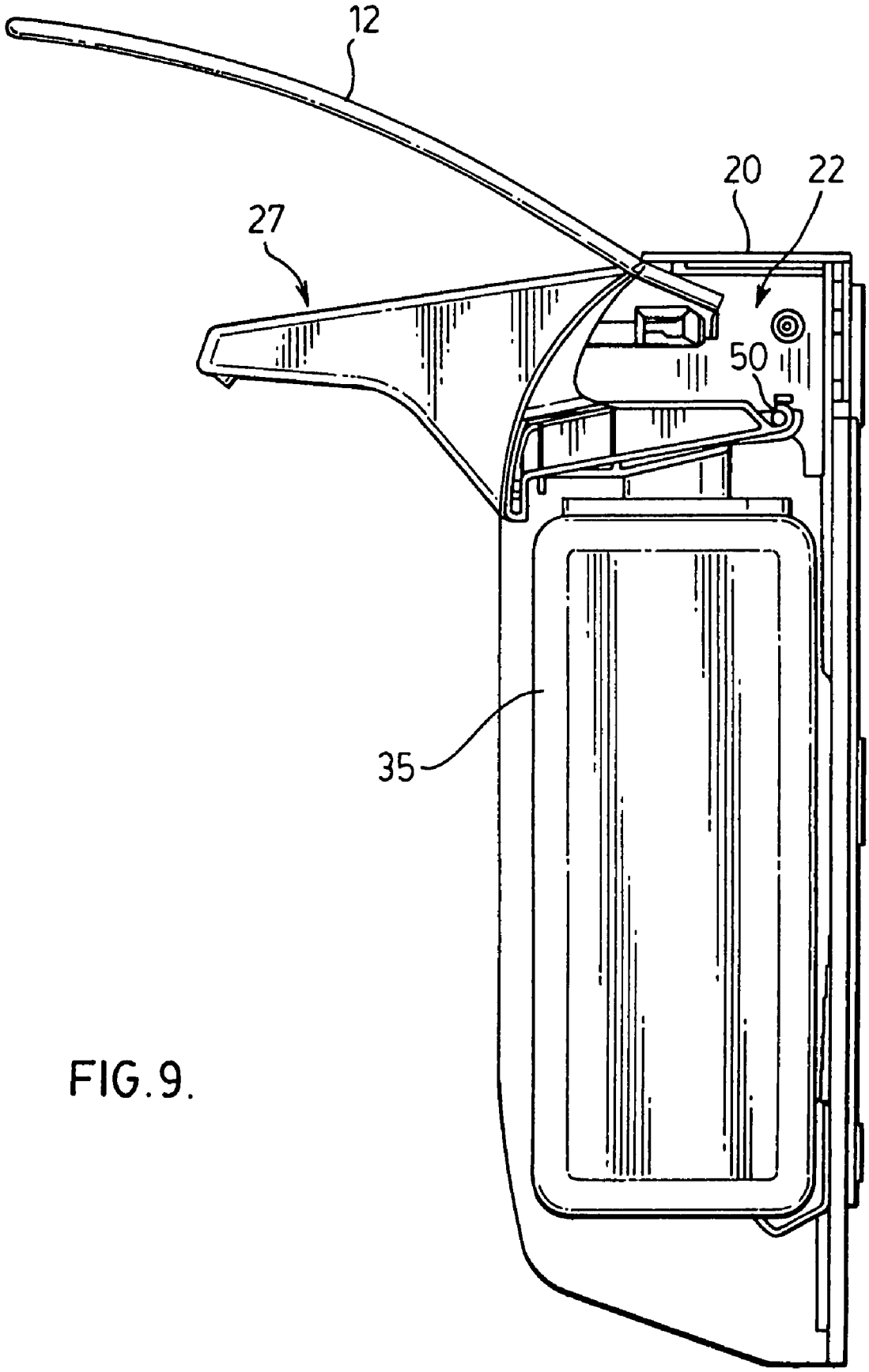
FIG. 9 is a schematic, partially cut-away cross-sectional side view of the dispenser in FIG. 1 with the nozzle shield in a closed position.
Figure 10:
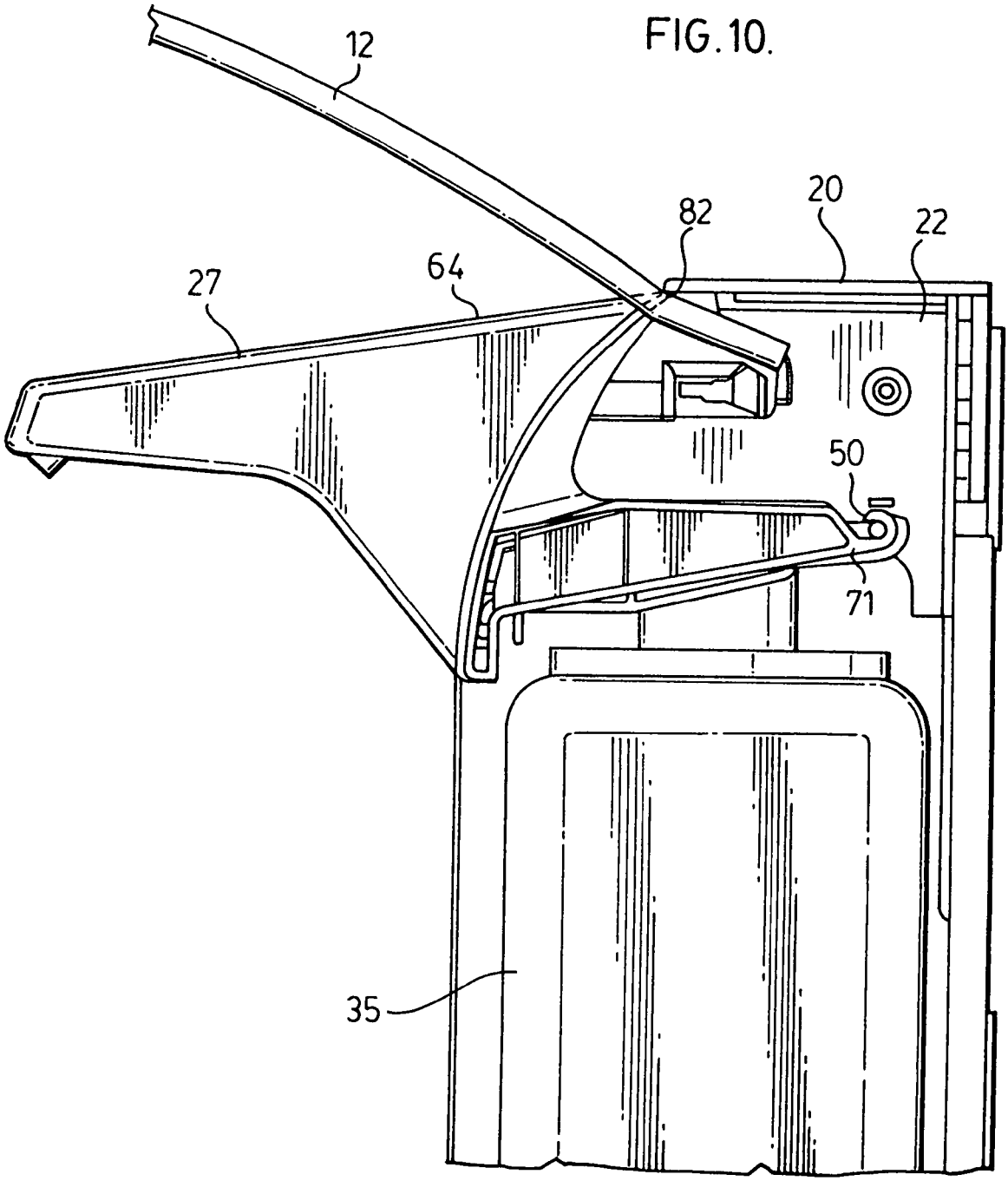
FIG. 10 is an enlarged side view the same as in FIG. 9 with the nozzle shield in a closed position.
Figure 11:
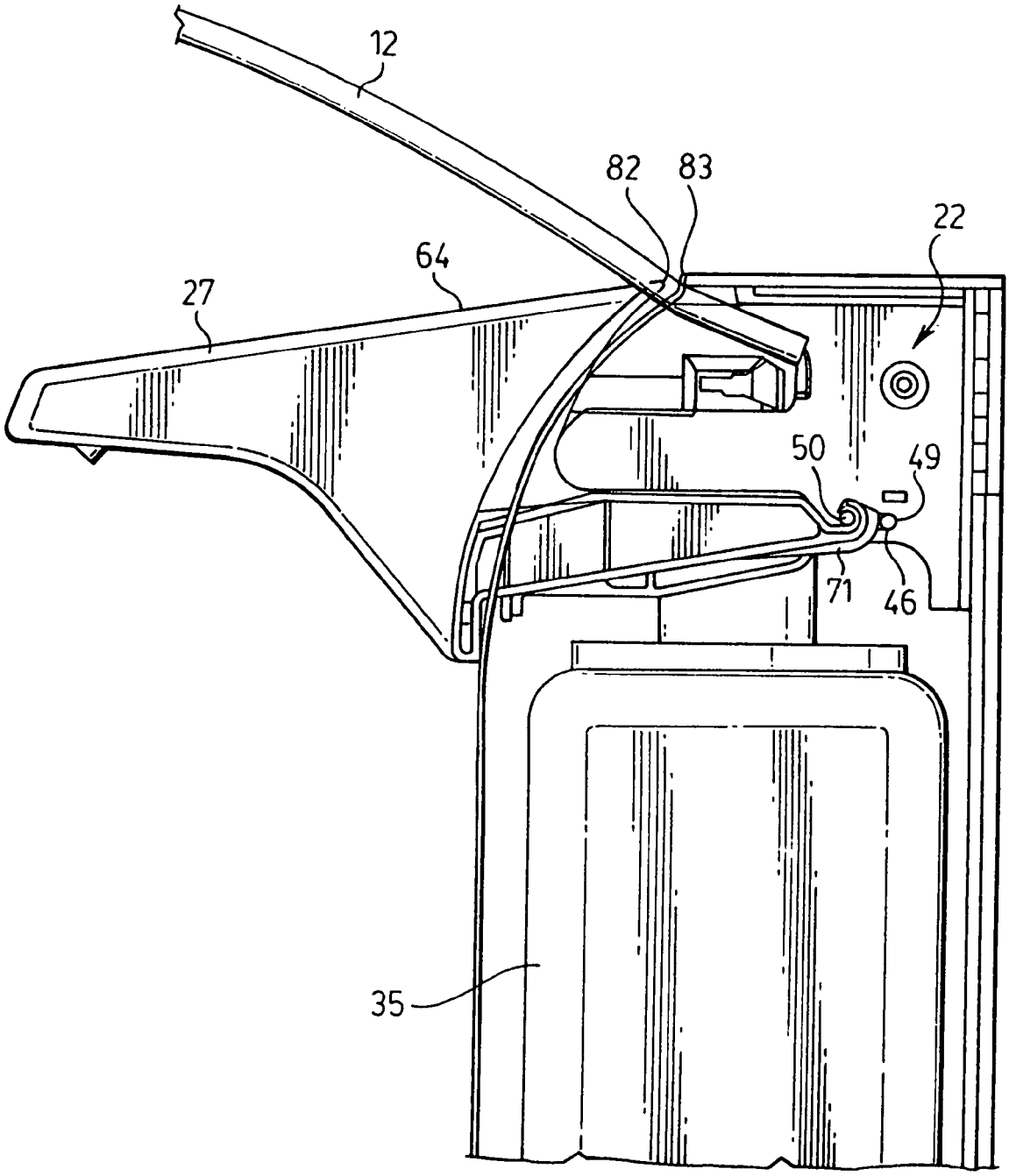
FIG. 11 is a side view the same as in FIG. 10, however, with the nozzle shield forward from the closed position in an intermediate position.
Figure 12:
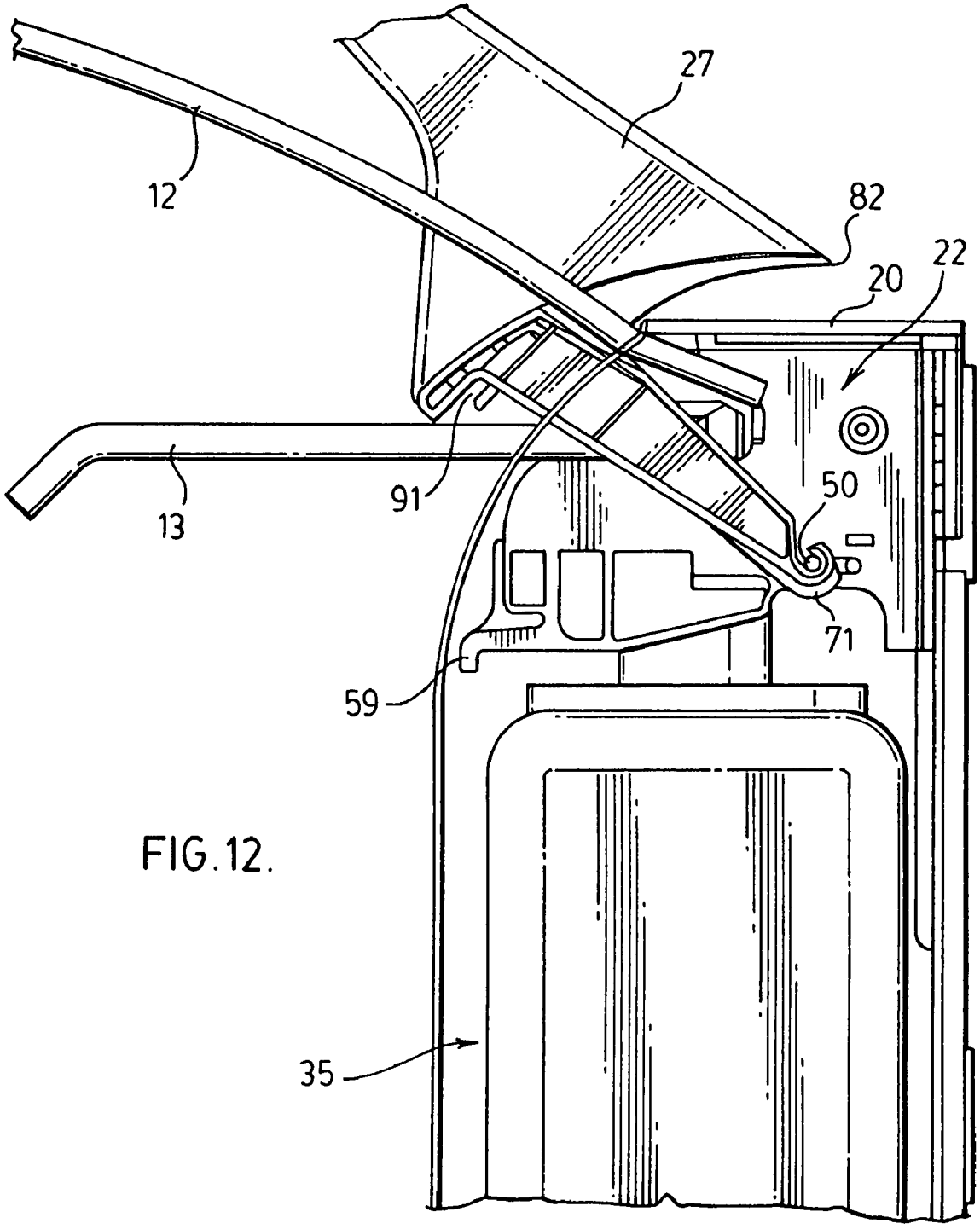
FIG. 12 is a side view the same as in FIG. 10, however, with the nozzle shield rotated upwardly from the intermediate position to an open position.

Reference is made to FIGS. 9 to 12 illustrating the nozzle shield 27 as coupled to the support member 22 for moving between a closed position as illustrated in FIGS. 1, 9 and 10 and an open position as illustrated in FIGS. 2 and 12. FIGS. 9 and 10 illustrate the nozzle shield 27 as coupled to the support member 22 in a closed position. As shown, the hook member 71 engages the axle member 50. In this regard, the axle member 50 is in the rear end 49 of the axle slotways 46 and 47 under the bias of the axle springs 52 and 53, not shown. The axle member 50 engages the bight end 76 of the blind slotway 75 of the hook member 71 and, thus, the axle member 50 under the bias of its axle springs 52 and 53 urges the nozzle shield 27 to assume the closed position as shown. In the closed position, while not clearly shown, the catch members 59 and 60 of the support member 22 are received within the catch cavities 80 of the nozzle shield 27. The downwardly directed stop surfaces 61 and 62 of the catch members 59 and 60 engage the upwardly directed stop surface 81 of the nozzle shield 27 so as to prevent the nozzle shield 27 from pivoting relative to the support member 22 about the axle member 50. Effectively, the receipt of the catch members 59 and 60 within the catch cavities 80 limits the movement of the nozzle shield 27 relative to the support member 22 to forward sliding.

From the position of FIG. 10, the nozzle shield 27 is manually slid forwardly relative to the support member 22 such that the hook members 71 draw the axle member 50 forwardly sliding the axle member 50 in the axle slotways 46 and 47 from the rear end 49 to the forward end 48 against the bias of the axle springs 52 and 53 to an intermediate position as seen in FIG. 11. On sliding the nozzle shield 27 forwardly from the closed position to the intermediate position, the stop surfaces 81 on the catch cavities 80 of the nozzle shield 27 slide forwardly on the stop surfaces 61 and 62 of the catch members 59 and 60 of the support member. When in the intermediate position, as shown in FIG. 11, the catch cavities 80 have moved sufficiently forwardly that the stop surfaces 81 are forward of the stop surfaces 61 and 62 of the catch members 59 and 60, with the result that in the intermediate position, the nozzle shield 27 is free to pivot about the axle member 50 from the intermediate position shown in FIG. 11 to a raised open position illustrated in FIG. 12.

While not necessary, it is also to be appreciated that in the closed position illustrated in FIG. 10, the upper rear end 82 of the top wall 64 of the nozzle shroud portion 63 is engaged underneath the top wall 20 of the housing 16 which also prevents pivoting of the nozzle shield 27 relative to the support member 22. In moving to the intermediate position illustrated in FIG. 11, the rear edge 82 of the top wall 64 of the nozzle shield moves to a position forward of the forward edge 83 of the top wall 20 of the housing 16 so as to not prevent pivoting of the nozzle shield 27 about the axle member 50.

To move from the closed position illustrated in FIG. 10 to the intermediate position illustrated in FIG. 11, a user draws the nozzle shield 27 forwardly against the bias of the axle springs 52 and 53. A user continues to maintain outward forces forward radially relative to the axle member 50 in manually swinging the nozzle shield 27 from the intermediate position of FIG. 11 to the open position of FIG. 12. On release of the nozzle shield 27 in the open position of FIG. 12, the bias of the axle springs 52 and 53 draws the nozzle shield 27 rearwardly thus effectively causing the nozzle shield as when left in an open position shown in FIG. 2 to maintain this position by the axle springs 52 and 53 causing interference between the rear edge 84 of the nozzle shield's side walls 65 and 66 and the forward edge 83 of the housing top wall 20. From the closed position shown in FIG. 12, a user may draw the nozzle shield 27 forwardly and radially away from the axle member 50 so as to draw the axle member 50 forwardly whereupon the user may then pivot the nozzle shield 27 to the intermediate position. On release in the intermediate position, the nozzle shield will under the bias of the axle springs 52 and 53 slide rearwardly to the closed position shown in FIGS. 9 and 10.

Figure 13:
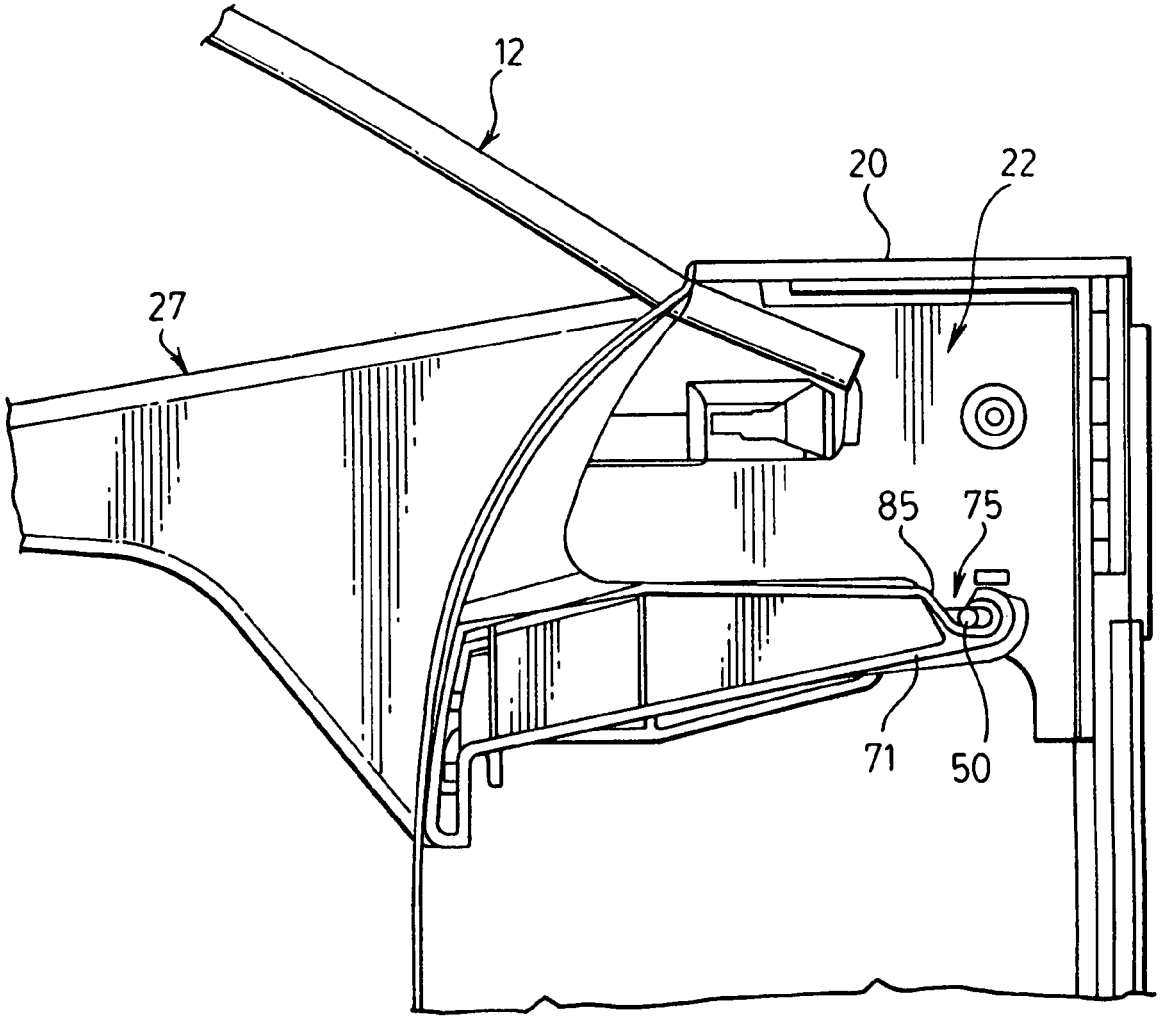
FIG. 13 is a side view the same as FIG. 10, however, with the nozzle shield in the closed position of FIG. 10 and the axle member moved forwardly within the slotway in the chassis.
Figure 14:
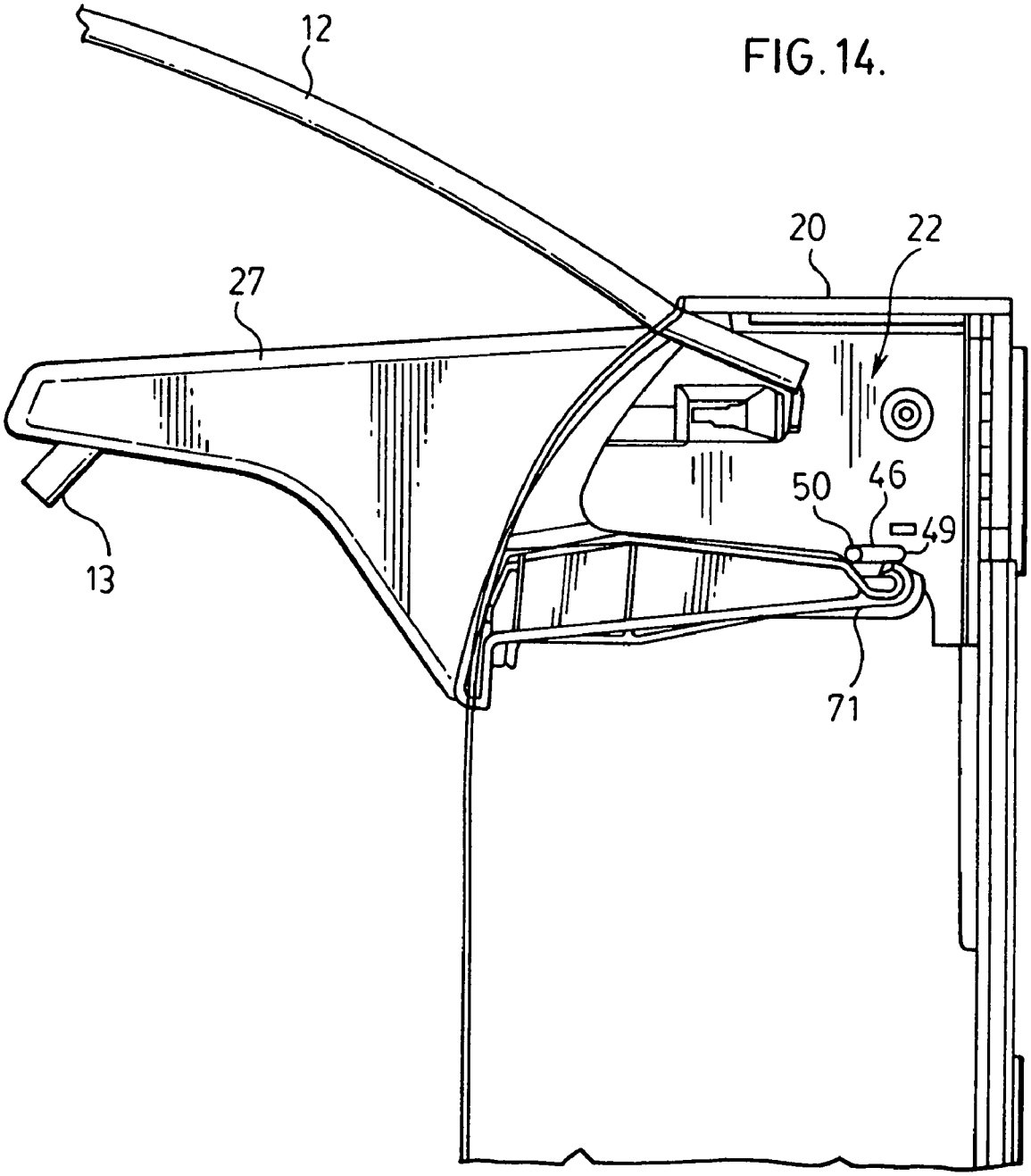
FIG. 14 is a side view similar to that shown in FIG. 13, however, in which the axle member has been moved to the forward end of the slotway in the chassis and has engaged the nozzle shield to urge the nozzle shield downwardly such that the axle member has become disengaged from the hook member carried on the nozzle shield.

Reference is made to FIGS. 4, 5, 13 and 14 showing the manner of removal of the nozzle shield 27 from engagement with the housing 16. Preferably, prior to removal of the nozzle shield 27, the dispenser 10 is configured by disassembly to remove the pump mechanism 28 and the bottle 35 and to place the nozzle shield 27 in the closed position as shown in FIG. 9 but with the pump mechanism 28 and bottle 35 removed. In such a position similar to FIG. 9, the axle member 50 under the bias of the axle springs 52 and 53 engages in the hook member 71 and draws the nozzle shield 27 rearwardly to the closed position. From this closed position, similar to that shown in FIG. 9, a user manually engages the axle member 50 and slides the axle member 50 forwardly in the axle slotways 46 and 47 from the rear end 49 towards the front end 48. FIG. 13 illustrates a position in which the nozzle shield 27 is in the same closed position as illustrated in FIG. 9 but the axle member 50 has been moved to a middle position forward from the rear end 49 of the axial slotways 46 and 47 and in which the forward side of the axle member 50 first commences to engage an engagement ramp surface 85 on a forward side of the blind slotway 75. With further rearward movement of the axle member 50 from the position of FIG. 13 to the forward end 48 of the axle slotways, the movement of the axle member 50 causes the axle member 50 to engage the entrance ramp surfaces 85 and move the nozzle shield 27 from its closed position as illustrated in FIG. 13 to pivot the hook member 71 downwardly such that the hook member 71 becomes disposed as illustrated in FIG. 14 with the pin member 50 disengaged from the hook member 71, that is, forward of and above the distal forward end 74. From the position of FIG. 14, the nozzle shield 27 may be manually slid forwardly for removal.

FIG. 4 schematically illustrates a situation in which the pump mechanism 28 and bottle 35 are removed, a person places their hand inside the interior 21 of the housing 16 with the fingers 15 to engage the axle member 50 underneath the support plate 29 and between the support member side plates 43 and 44 and urge the axle member 50 forwardly against the bias of the axle springs 52 and 53 and, thus, move the axle member from the closed position to the middle position of FIG. 13 and, hence, to the disengaged forward position of FIG. 14 such that the nozzle shield 27 will become marginally rotated to have its hook member 71 moved downwardly and the nozzle shield 27 may then be moved forwardly to disengage it from the support member 22 and the housing 15.

FIG. 5 illustrates a condition in which the nozzle shield 27 is displaced from and removed from the housing 16 and in which position the nozzle shield 27 may be recoupled to housing 16 by repeating the steps used to withdraw the same including preferably manual forward movement of the axle member 50.

Figure 15:
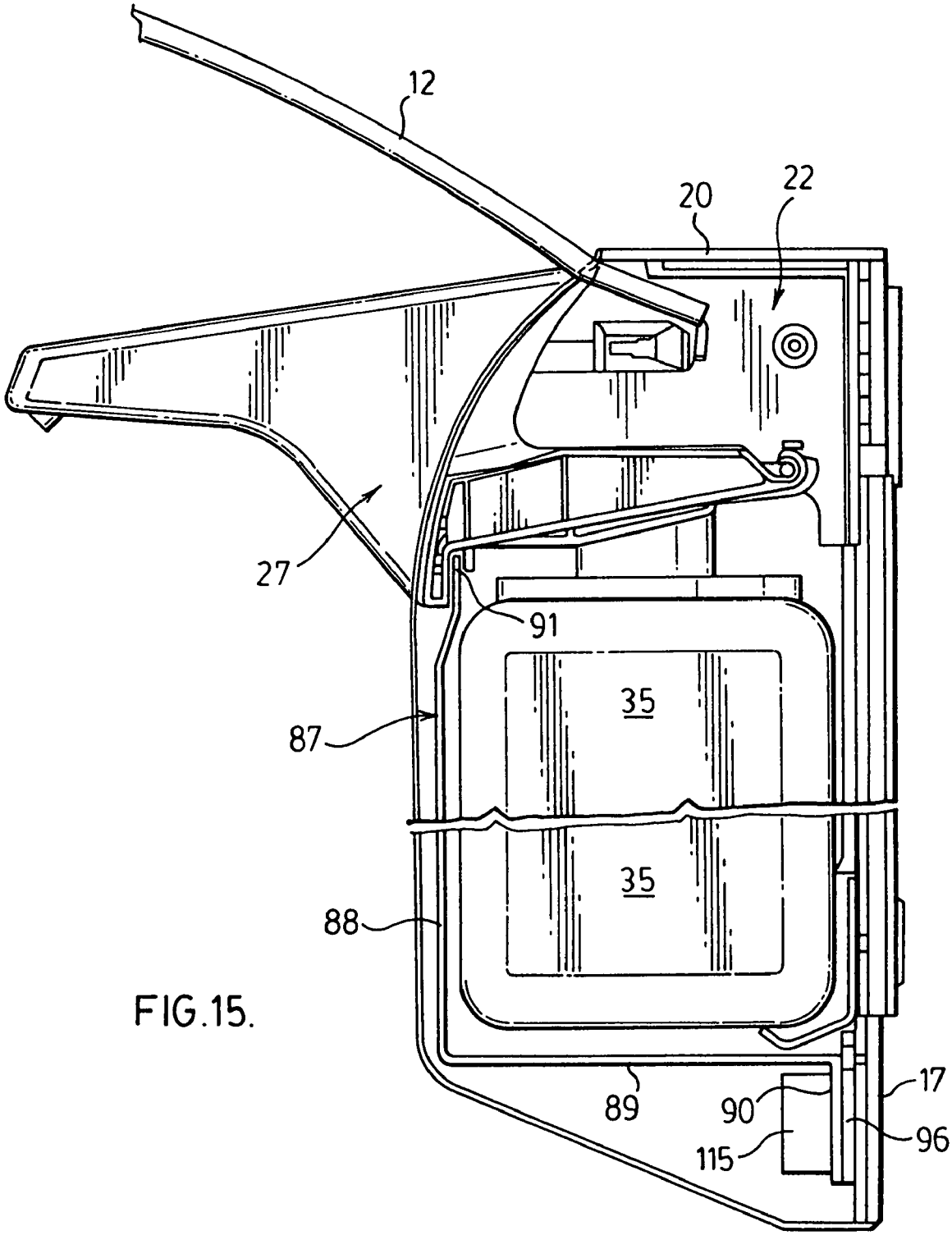
FIG. 15 is a schematic cross-sectional side view similar to that shown in FIG. 2, however, of a second embodiment including a face plate attached to the housing.

Reference is made to FIG. 15 which illustrates a second embodiment in accordance with the present invention which is identical to the embodiment illustrated in FIGS. 1 to 14, however, includes a cover plate 87 which extends between the side walls 18 and 19 of the housing and closes the interior 21 of the housing from the lower front of the nozzle shield 27 to the back plate underneath the bottle 35. The cover plate 87 is shown in FIG. 15 in a vertically shortened side view. The cover plate 87 is preferably relatively rigid as, for example, formed from sheet metal and has a front wall 88, a bottom wall 89 and a rear wall 90. The cover plate is arranged such that the rear wall 90 of the cover plate 87 is fixedly secured the back plate 17 of the housing in vertical face to face relation with the bottom wall 89 to extend underneath the bottle 35 forwardly to where the front wall 88 rises upwardly between side walls 18 and 19 of the housing 16. The front wall 88 has its upper edge 91 engaged in downwardly directed slots 92 on each hook arm 69 and 70 and, as well, with the upper edge 91 of the front wall 88 received rearward of the catch members 59 and 60 carried on the support member 22. Engagement of the front wall 88 of the cover plate behind the catch members 59 and 60 prevents forward movement of the cover plate 87. Engagement of the front wall 88 within the slots 92 on the hook arms 69 and 70 of the nozzle shield 27 prevents the nozzle shield from being moved forwardly. The slots 92 on the hook arms 71 are shown in FIG. 6 as open downwardly and vertically extending between a forward protrusion 93 and a rear tab 94. Since the nozzle shield 27 is prevented from being moved forwardly, the nozzle shield can neither be moved from the closed position to the intermediate position or the open position. The cover plate 87 also prevents access to the axle member 50 for removal of the nozzle shield 27.

The cover plate 87 may have its rear wall 90 releasably secured to the back plate 17 of the housing 16 by various mechanisms including a lockable mechanism 115 which may be carried by the cover plate 87 and releasably engage with a rectangular, oblong lock aperture 95 as seen in FIG. 5 in a rear cross member 96 secured between housing side walls 18 and 19 which latching engagement of the cover plate 87 to the housing 16 may be provided as with a key-lock mechanism to provide increased tamper-proof protection if desired.

Figure 16:
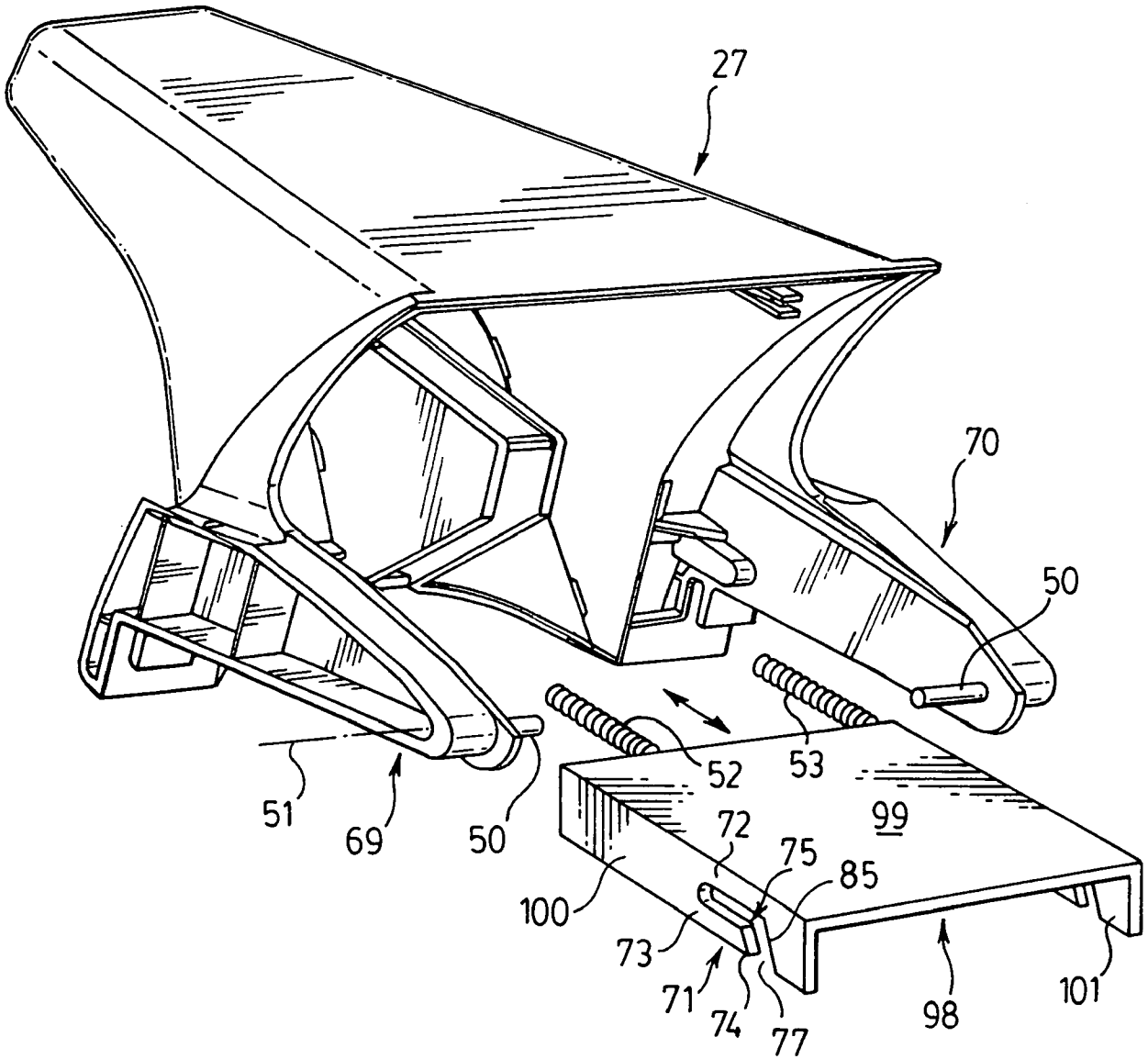
FIG. 16 is a schematic pictorial view of a third embodiment of a dispenser with an alternate coupling mechanism between a nozzle shield and the housing chassis.

Reference is made to FIG. 16 which illustrates a third embodiment of the dispenser with a different coupling mechanism. The coupling mechanism as illustrated in FIG. 16 is effectively a reversal of the coupling mechanism illustrated in the first embodiment with the hook member 71 being carried on a slide 98 slidably coupled on the support member 22 (not shown in FIG. 16) and the axle members 50 being carried on the nozzle shield 27. FIG. 16 is intended to schematically show an arrangement for coupling of a nozzle shield 27 to portions of a notional support member 20. In FIG. 16, the support member 20 is intended to be similar to that in FIG. 7 but carry a slide, thereon which is slidable forwardly and rearwardly relative to the remainder of the support body 98 and biased to a rearward position by springs shown as 52 and 53. This slide 98 has a main plate 99 disposed generally horizontally and carrying two vertically extending side legs 100 and 101. Each side leg 100 and 101 forms a hook member 71 therein with a notional shank portion 72, a bight forming portion 73, a distal rear end 74, a blind slotway 75, a bight end and an entranceway 77 with an entranceway ramp shown as 85.

The nozzle shield 27 of FIG. 16 is the same as in FIG. 7 but that the arms 69 and 70 which extend rearwardly do not have hook members but rather each carry an inwardly extending horizontal stub axle 50, with the stub axles disposed about the same axis 51. The stub axles are adapted to be engageable and disengageable with the hook member 71 in a manner analogous to that with the first embodiment. As with the first embodiment, in a closed position, the axle springs 52 and 53 urge the slide 98 rearwardly drawing the nozzle shield 27 to a closed position. For opening, manual forward movement of the nozzle shield 27 slides the nozzle shield forwardly drawing the slide 98 with it against the bias of the springs to an intermediate position in which the nozzle shield 27 may be pivoted about the stub axles 50 to an upper open position.

For removal of the nozzle shield 27, with the nozzle shield in the closed position, the slide 98 may be manually moved forward against the bias of the springs 52 and 53 such that the entrance ramp surface 85 engages the stub axles 50 and moves the nozzle shield 27 such that the stub axles 50 become disengaged from the hook members 71.

The preferred embodiments have been structured for use with a nozzle shield to be provided at the top of a fluid dispenser 10 for opening by movement upwardly. It is appreciated that a similar dispenser could be provided orientated, for example, with the nozzle shield 27 to be at the bottom of a dispenser and to pivot to an open position downwardly. A similar type nozzle shield to be provided for opening, for example, to the side or in some other orientation. The nozzle shield 27 has also been illustrated as extending forwardly over a nozzle which extends forwardly from the dispenser. It is appreciated that this is not necessary and the nozzle shield might merely provide a front cover to the dispenser and not extend forwardly beyond the remainder of the dispenser or cover a nozzle yet have similar arrangements for moving between an open and closed position and also for ease of removal.

In the preferred embodiment as illustrated in FIG. 4, manual forward movement of the axle member 50 is required for removal and replacement of the nozzle shield 27. This has the requirement that at least the bottle 35 and preferably the pump mechanism 28 is removed prior to removal of the nozzle shield. This arrangement is satisfactory, however, if it is desired that the nozzle shield 27 be removed without removing the pump mechanism 28 or bottle 35, this could be arranged in a number of manners. One manner would be to remove the housing 10 from engagement as to a wall so as to provide for access to the axle member 50 through the rear of the back plate 14 even though the bottle 35 and lever mechanism 28 may remain in place. Another arrangement would be to provide some mechanism for forward movement of the axle member 50 from the front of the interior 21 of the housing when the bottle 35 and/or pump mechanism 28 are in place. A lever mechanism could be provided accessible from the front of the interior 21 of the housing to be pivoted to move the axle member 50 forwardly. A pull member including a string or wire harness could also be provided which could be grasped from the front of the interior and drawn forwardly as to move the axle member 50 forwardly. Many other arrangements for providing for movement of the axle member 50 to its forward position may be provided other than merely engagement by a person's fingers as illustrated in FIG. 4.

While the invention has been described with reference to preferred embodiments, many modifications and variations will now occur to persons skilled in the art. For a definition of the invention, reference is made to the appended claims.

The invention claimed is:

1. A fluid dispenser having a housing, an axle member carried by the housing, the axle member disposed about a longitudinal axis, the axle member being movable relative the housing in a direction normal to the axis between a first rear position and a second forward position, an axle biasing member urging the axle member to assume the first rear position, the axle member being movable from the first rear position to the second forward position against the bias of the biasing member, a cover coupled to the housing for movement between a closed position in which the dispenser is operative for dispensing fluid and an open position in which access is provided to an interior of the housing, the cover having a rearwardly extending hook member, the hook member removably engaging the axle member, wherein when the hook member engages the axle member: (a) the cover is in the closed position when the axle member is in the first rear position, (b) the axle biasing member in urging the axle member to the first position urges the cover to the closed position, and (c) movement of the cover from the closed position to the open position moves the axle member from the first rear position to the second forward position against the bias of the axle biasing member, the hook member being engageable and disengageable from the axle member for coupling and uncoupling of the cover relative to the housing when the axle member is in the second front position and the cover member is proximate the closed position.

2. A fluid dispenser as claimed in claim 1 wherein the axle member extends side to side across the housing in a horizontal direction, the housing has a forward opening providing access to the interior of the housing, the cover covers the forward opening of the housing in the closed position, the hook member having a shank portion extending rearwardly to a bight forming portion which curves forwardly to a distal forward end defining a blind slotway closed at a rearmost bight end and extending forwardly and upwardly to open at an upwardly directed entranceway forward of the bight between the shank portion and the distal end, when the axle member is engaged in the rear most blind end, the axle member extends horizontally through the hook member with the shank portion below the axle member, with the distal hook end above the axle member and with the entranceway to the blind slotway on an upper side of the shank portion and opening outwardly and upwardly from the blind slotway, wherein by maintaining the cover against forward movement from the closed position while moving the axle member from the first rear position to the second forward position, engagement between the axle member and the blind slotway relatively camming the cover to move to a relative position with the axle member in the entranceway from which the axle member can be disengaged from the hook member by subsequent forward sliding of the cover relative the housing.

3. A fluid dispenser as claimed in claim 1 wherein the hook member having a shank portion extending rearwardly to a bight forming portion which curves forwardly to a distal forward end defining a blind slotway closed at a rearmost bight end and open via an entranceway forward of the bight forming portion between the shank portion and the distal end.

4. A fluid dispenser as claimed in claim 1 wherein by maintaining the cover against forward movement from the closed position while moving the axle member from the first rear position to the second forward position, engagement between the axle member and hook member relatively camming the axle member to move to a position in which the axle member can be disengaged from the hook member by subsequent forward sliding of the cover relative the housing.

5. A fluid dispenser as claimed in claim 4 wherein the axle member extends side to side across the housing in a horizontal direction, the housing has a forward opening providing access to the interior of the housing, the cover covers the forward opening of the housing in the closed position.

6. A fluid dispenser as claimed in claim 5 wherein the cover in moving between the closed position and the open position assuming an intermediate position between the closed position and the open position, the cover in moving between the closed position and the intermediate position moving forwardly relative the housing, the cover in moving between the intermediate position and the open position pivoting about the axle member relative the housing.

7. A fluid dispenser as claimed in claim 6 including rotation stop surfaces carried on the housing to engage the cover and prevent pivoting of the cover about the axle member when the axle member is received in the bight end of the blind slotway of the hook member and the cover is between the closed position and the intermediate position.

8. A fluid dispenser as claimed in claim 7 wherein the cover in moving from the intermediate position to the open position and pivoting about the axle member moves upwardly relative the housing to provide access to the interior below the cover.

9. A fluid dispenser as claimed in claim 8, the axle member extends horizontally through the hook member with the shank portion below the axle member, with the distal hook end above the axle member and with the entranceway to the blind slotway on an upper side of the shank portion and opening outwardly and upwardly from the blind slotway.

10. A fluid dispenser as claimed in claim 9 wherein the cover has a pair of rearwardly extending hook arms spaced side-to-side on the cover and with each hook arm carrying one said hook member at a rear end thereof, each said hook member engaging the axle member at side-to-side spaced locations.

11. A fluid dispenser as claimed in claim 8 including a pump mechanism within the interior of the housing having a dispensing nozzle which extends forwardly beyond the housing for dispensing downwardly, the cover comprising a shroud overlying the nozzle and at least partially protecting the with the nozzle from engagement by a user when the cover is in the closed position.

12. A fluid dispenser as claimed in claim 11 wherein the pump mechanism is coupled to the housing for removal when the cover is in the open position, and prevented from removal when the cover is in the closed position.

13. A fluid dispenser as claimed in claim 12 including a fluid reservoir within the interior of the housing from which fluid is to be dispensed, the reservoir coupled to the pump mechanism with the pump mechanism and reservoir being removable as a unit from the interior for replacement when the cover is in the open position, the cover comprising a shroud overlying the nozzle and at least partially protecting the nozzle from engagement by a user when the cover is in the closed position, the cover extends forwardly.

14. A fluid dispenser as claimed in claim 1 including a cover latch member releasably secured to the housing, the cover latch when secured to the housing with the cover in the closed position preventing movement of the cover from the closed position toward the open position.

15. A fluid dispenser as claimed in claim 14 wherein the cover latch member provides a removable cover plate which when secured to the housing prevents access to the interior of the housing.

16. A fluid dispenser as claimed in claim 14 wherein the housing carries in the interior a support plate for supporting a pump mechanism, the cover latch member when secured to the housing engages with stop surface on a forward portion of the support plate which stop surface prevents forward movement of the cover latch member.

17. A fluid dispenser having a housing, a cover coupled to the housing for movement between a closed position in which the dispenser is operative for dispensing fluid and an open position in which access is provided to an interior of the housing, the cover and the housing coupled together by a releasable connection mechanism including an axle member disposed about an longitudinal axis carried by a first member selected from the cover and the housing, and a hook member carried by a second member which selected from the cover and the housing but is not the first member, the one of the axle member and hook member which is carried by the housing being movable relative the housing in a direction normal to the axis between a first rear position and a second forward position, a biasing member urging the one of the axle member and hook member which is carried by the housing to assume the first rear position, the one of the axle member and hook member which is carried by the housing being movable from the first rear position to the second forward position against the bias of the biasing member, the hook member removably engaging the axle member, wherein when the hook member engages the one of the axle member and hook member which is carried by the housing: (a) the cover is in the closed position when the one of the axle member and hook member which is carried by the housing is in the first rear position, (b) the axle biasing member in urging the one of the axle member and hook member which is carried by the housing to the first position urges the cover to the closed position, and (c) movement of the cover from the closed position to the open position moves the one of the axle member and hook member which is carried by the housing from the first rear position to the second forward position against the bias of the axle biasing member, the hook member being engageable and disengageable from the axle member for coupling and uncoupling of the cover relative to the housing when the one of the axle member and hook member which is carried by the housing is in the second front position and the cover member is proximate the closed position.

18. A fluid dispenser as claimed in claim 17 wherein the cover is the first member and the housing is the second member, the hook member having a shank portion extending forwardly to a bight forming portion which curves rearwardly to a distal rear end defining a blind slotway closed at a forwardmost bight end and open via an entranceway rearward of the bight.

19. A fluid dispenser as claimed in claim 18 the axle member extends horizontally through the hook member with the distal hook end below the axle member and with the entranceway to the blind slotway on a lower side of the shank portion and opening outwardly and downwardly from the blind slotway.

20. A fluid dispenser as claimed in claim 17 wherein by maintaining the cover against forward movement from the closed position while moving the one of the axle member and hook member which is carried by the housing from the first rear position to the second forward position, engagement between the axle member and hook member relatively camming the axle member to move to a position in which the axle member can be disengaged from the hook member by subsequent forward sliding of the cover relative the housing.

* * * * *